US008368501B2

(12) United States Patent
Hazucha et al.

(10) Patent No.: US 8,368,501 B2
(45) Date of Patent: Feb. 5, 2013

(54) INTEGRATED INDUCTORS

(75) Inventors: Peter Hazucha, Beaverton, OR (US); Trang T. Nguyen, Beaverton, OR (US); Gerhard Schrom, Hillsboro, OR (US); Fabrice Paillet, Hillsboro, OR (US); Donald S. Gardner, Mountain View, CA (US); Sung T. Moon, Hillsboro, OR (US); Tanay Karnik, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 948 days.

(21) Appl. No.: 11/478,996

(22) Filed: Jun. 29, 2006

(65) Prior Publication Data

US 2008/0001698 A1 Jan. 3, 2008

(51) Int. Cl.
*H01F 5/00* (2006.01)

(52) U.S. Cl. ..... 336/200

(58) Field of Classification Search ..... 336/65, 336/83, 200, 232, 192; 257/531; 361/760–766
See application file for complete search history.

(56) References Cited

U.S. PATENT DOCUMENTS 6,031,445 A * 2/2000 Marty et al. ..... 336/200
6,362,525 B1 * 3/2002 Rahim ..... 257/738
6,362,986 B1 3/2002 Schultz et al.
6,452,247 B1 9/2002 Gardner
6,710,433 B2 * 3/2004 Megahed et al. ..... 257/678
6,727,154 B2 4/2004 Gardner
6,856,226 B2 2/2005 Gardner
6,856,228 B2 2/2005 Gardner
6,870,456 B2 3/2005 Gardner
6,880,232 B2 4/2005 La Valle et al.
6,891,461 B2 5/2005 Gardner
6,943,658 B2 9/2005 Gardner
6,972,658 B1 * 12/2005 Findley et al. ..... 336/200
6,980,075 B2 * 12/2005 Mheen et al. ..... 336/200
6,988,307 B2 1/2006 Gardner
7,038,309 B2 * 5/2006 Hsu et al. ..... 257/698
7,064,646 B2 6/2006 Gardner
7,170,384 B2 * 1/2007 Kim et al. ..... 336/200
7,279,391 B2 * 10/2007 Hsu et al. ..... 438/381
7,280,024 B2 * 10/2007 Braunisch ..... 336/200
7,339,452 B2 * 3/2008 Lee ..... 336/200
7,504,922 B2 * 3/2009 Lee ..... 336/200
2003/0006474 A1 1/2003 Gardner
2005/0184844 A1 8/2005 Valle et al.
2006/0071649 A1 4/2006 Schrom et al.

OTHER PUBLICATIONS

Hazucha, Peter et al., U.S. Appl. No. 11/141,320, entitled "Power Transformer," filed Jun. 1, 2005.
Hazucha, Peter et al., U.S. Appl. No. 11/479,626, entitled "Integrated Inductors," filed Jun. 29, 2006.

* cited by examiner

*Primary Examiner* — Tuyen Nguyen
(74) *Attorney, Agent, or Firm* — Blakely, Sokoloff, Taylor & Zafman LLP

(57) ABSTRACT

Multiple-inductor embodiments for use in substrates are provided herein.

13 Claims, 7 Drawing Sheets

300

INTEGRATED INDUCTORS

BACKGROUND

Inductors are used in a wide variety of integrated circuit applications including voltage regulators such as switching power converters. An inductor is a conductor that is shaped in a manner to store energy in a magnetic field adjacent to the conductor. An inductor typically has one or more "turns" that concentrate the magnetic field flux induced by current flowing through each turn of the conductor in an "inductive" area defined within the inductor turns.

Inductors have been implemented in integrated circuit packages but they may have several drawbacks. They have typically been made by forming helical or spiral traces in conductive layers (such as in conductive substrate layers) to form inductor turns. The traces may or may not be coupled to traces in adjacent layers in order to achieve higher inductance and/or current capability. Unfortunately, they can consume excessive trace layer resources and may not provide sufficient current capacity without unreasonable scaling. In addition, because their inductive areas are substantially parallel with respect to other trace layers in the substrate and circuit die, they can have unfavorable electromagnetic interference (EMI) effects on other components within the integrated circuit and/or their inductor characteristics can be adversely affected by adjacent conductors within the substrate. Accordingly, a new inductor solution is desired.

BRIEF DESCRIPTION OF THE DRAWINGS

Embodiments of the invention are illustrated by way of example, and not by way of limitation, in the figures of the accompanying drawings in which like reference numerals refer to similar elements.

DETAILED DESCRIPTION

In accordance with some embodiments, multiple inductor configurations suitable for use in substrates such as IC package substrate and board substrates are presented. In some embodiments, they can be implemented with conventional and/or simple manufacturing technologies without the need for extreme process changes.

Figure 1A:
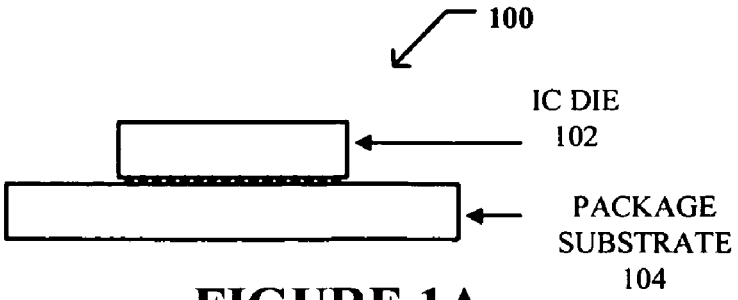
FIGURE 1A (PRIOR ART)
FIG. 1A is a diagram of a conventional integrated circuit.

FIG. 1A shows a conventional integrated circuit (IC) 100 generally comprising at least one semiconductor die 102 electrically coupled (e.g., through solder bumps) to a package substrate 104. The die 102 may be electrically coupled to the substrate throughout the majority of its undersurface (as is the case, for example, with a flip-chip type package) which allows for increased external connections having greater current capacity.

Figure 1B:
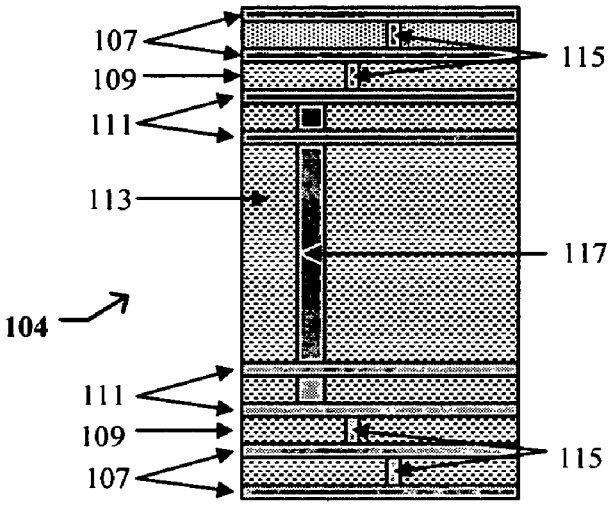
FIGURE 1B (PRIOR ART)
FIG. 1B is a sectional view of a portion of the package substrate from the integrated circuit of FIG. 1A.

FIG. 1 B is a cross-sectional view of the substrate 104 from an IC of FIG. 1A. The substrate 104 comprises an insulative core (e.g., made from plastic, ceramic, or some other suitable material) 113 sandwiched between conductive core layers 111, insulative (e.g., core) layers 109, and conductive build-up layers 107. The die 102 is typically electrically coupled through its contacts on a build-up layer 107 (e.g., "upper" layer) using solder bumps or some other suitable contacts. From there, vias (micro vias 115 and plated through holes 117) electrically couple the die contacts to desired portions (e.g., traces) of the different conductive layers 111, 107 to couple them, for example, to a socket or circuit board housing the substrate.

A plated through hole (PTH) is a type of via. As used herein, the term "via" refers to a conductive member in a substrate that can be used to electrically couple two or more spaced apart conductive layers in a substrate. Plated through holes are normally used to couple traces separated by farther distances, while micro vias 115 are typically used to couple extreme outer (upper and lower) trace layers to adjacent layers. Typically, vias are formed from a hole lined and/or filled with a conducting material (e.g., copper). They are usually disposed perpendicularly to the plane of the substrate but can be angled, so long as they have a perpendicular component thereby allowing them to span two or more layers. Depending on the size of the substrate and number of needed electrical connections, a substrate may have hundreds or thousands of vias and in many cases, have capacity for even more.

Figure 2:
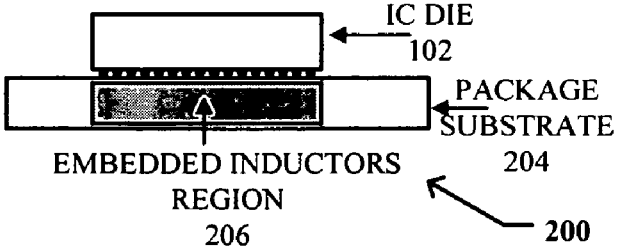
FIG. 2 is a diagram of an integrated circuit with embedded substrate inductors in accordance with some embodiments.

FIG. 2 shows an IC 200 in accordance with some embodiments of the invention. It generally comprises at least one IC die 102 electrically coupled to a substrate 204 having a region 206 with one or more embedded inductors in accordance with embodiments disclosed herein. While IC 200 shows only a single die 202, it could comprise a number of additional dies and may perform a variety of functions. For example, in some embodiments, it comprises one or more power converter circuits, such as a circuit described below, using one or more inductors in the embedded inductor region 206.

As discussed below, the inductor region 206 may comprise multiple inductors configured for efficient use of substrate space, while at the same time, addressing the detrimental effects of inductor parasitics, which can be more problematic with the use of inductors not using magnetic cores to better focus magnetic flux. It should be noted that parasitic destructive inductor coupling can be exacerbated when inductors are disposed closely together. Moreover, in some embodiments, configurations may also enhance power converter input and output ripple reduction, which not only improves the output voltage, but also, decreases generated electro-magnetic interference (EMI).

Figure 3A:
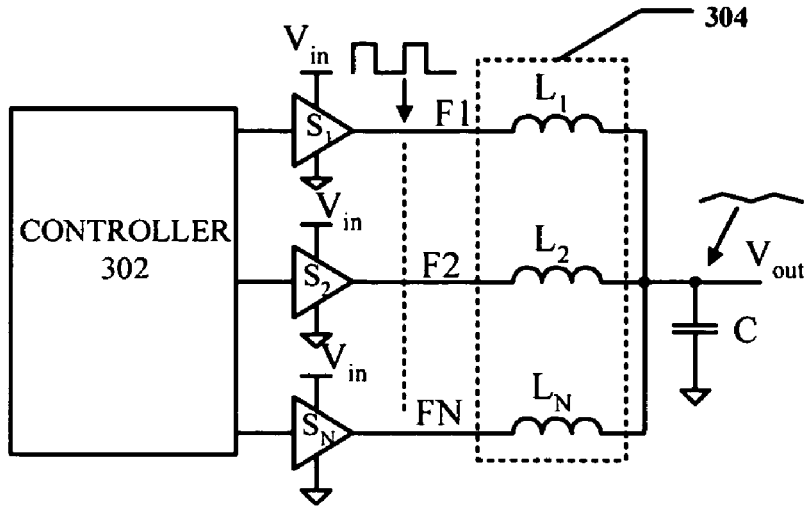
FIG. 3A is a schematic diagram of a power converter with inductors in accordance with some embodiments.

FIG. 3A shows a multi-phase "buck" type switching power converter with multiple (N) inductors 304, configured in accordance with some embodiments. The depicted converter generally comprises a controller (also sometimes referred to as a pulse width modulator) 302 coupled to driver switches (or switches) $S_1$ to $S_N$, which in turn are coupled to inductors, $L_1$ to $L_N$, and capacitor C to generate a regulated DC output voltage $V_{out}$. Typically, the depicted converter is used to "step down" from a larger DC voltage ($V_{in}$) to a smaller, regulated DC voltage ($V_{out}$).

Controller 302 generates control (e.g., trigger) signals that are applied to the switches. Based on its applied control signal, each switch produces a pulse train voltage signal whose magnitude ranges between the applied input value ($V_{in}$) and the low-side reference ($V_{SS}$). The pulse train signal produced from each switch is applied to an input (Fi) of an associated inductor. The duty cycle of a pulse train signal applied to an inductor generally determines the magnitude of the voltage generated at the output of the inductor ($V_{out}$).

The control signals for the different switches ($S_1$ to $S_N$) are skewed in time (phase shifted) so that switching noise from each inductor is distributed in time. The capacitor C filters ripple, along with AC noise, at the output DC voltage ($V_{out}$).

The inductors 304 are formed in a substrate, typically adjacent to a semiconductor die housing at least the driver switches. (The substrate may be a substrate in an IC package, within a board, or in some other suitable assembly.) Moreover, they may comprise any suitable number of inductors, depending on inductor configurations and the number of utilized phases. The following sections describe some different ways to implement the inductors 304.

Figure 4A:
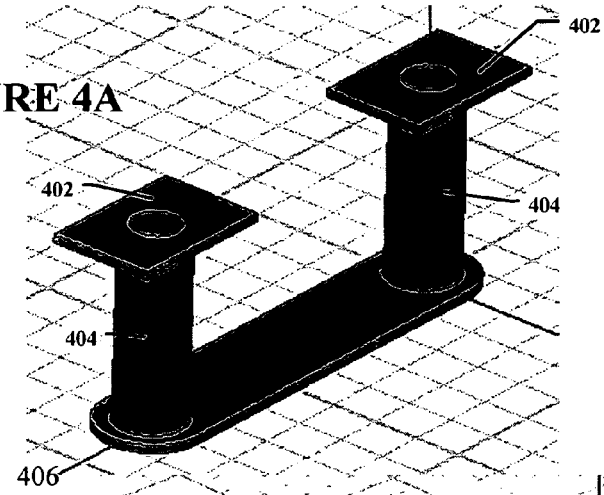
FIG. 4A is a perspective view of an inductor in accordance with some embodiments.

FIG. 4A shows an inductor suitable for use as one of the embedded inductors 304 in accordance with some embodiments. It comprises spaced apart vias 404 coupled together at common (e.g., "lower") ends with a portion (e.g., trace) 406 of a conductive layer. At their other ends, they are coupled to conductive layer portions 402, which serve as terminals for the inductor.

The spaced apart vias 404 and conductive layer portion 406 make up a single inductor "turn." (Note that the "turn" is left substantially open (between the terminals) which may or may not be the case with other embodiments. For example, with embodiments described below, the inductor turns are more closed off.) Together, the vias 402 and conductive layer portion 406 define a core region, the cross section of which, in this embodiment, is rectangularly shaped. As used herein, this cross-sectional core area is referred to as the inductor area.

Figure 4B:
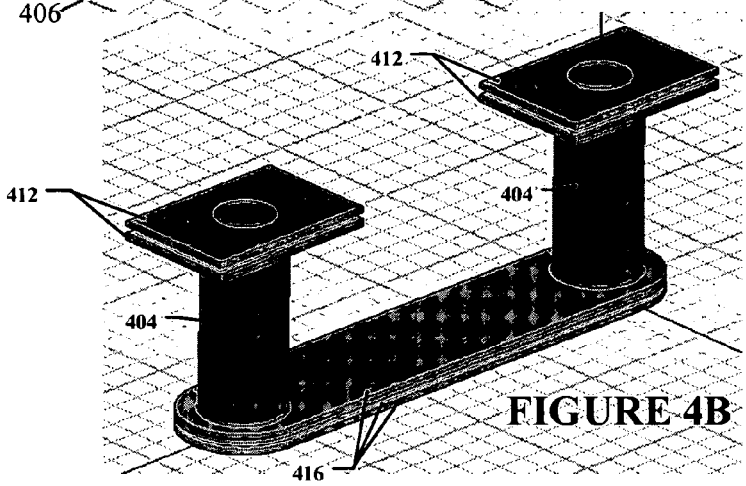
FIG. 4B is a perspective view of an inductor with multiple conductive layers in accordance with some embodiments.

FIG. 4B shows another embodiment of an inductor. As with the inductor of FIG. 4A, it has spaced apart vias 404, but instead of a single conductive layer coupling them together, it uses multiple, conductive layer portions 416 to couple the vias together at a common end of the vias. It also uses multiple, conductive layer portions 412 coupled to the vias at their other ends for their inductor terminals. Multiple conductive layer portions can provide for less inductor resistance, resulting in higher inductor Q (discussed below) and greater current capacity. This can be valuable for power converter applications to achieve increased efficiency and to be able to service larger load demands.

Figure 3B:
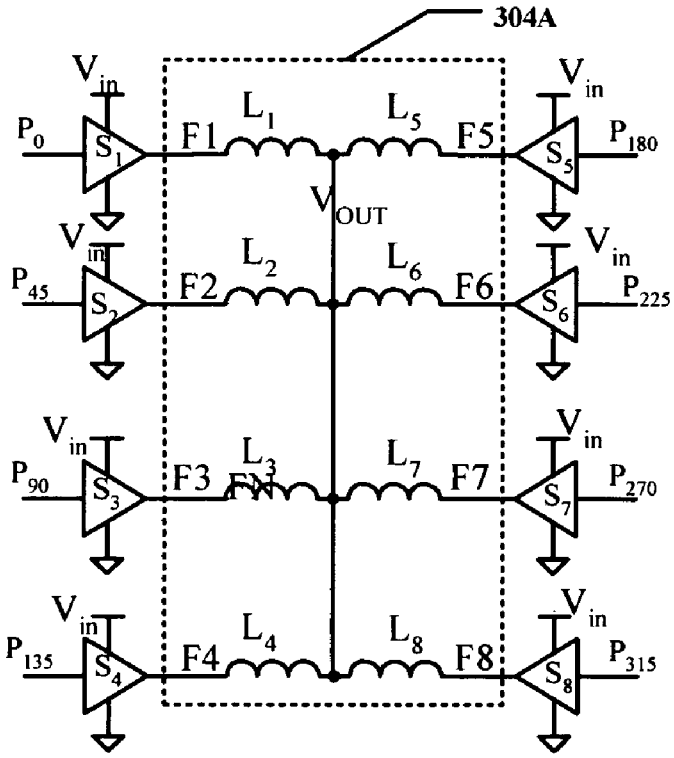
FIG. 3B is a schematic diagram of a portion of the power converter of FIG. 3A in accordance with some embodiments.

FIG. 3B shows inductors 304A coupled to associated switches ($S_1$ to $S_8$) for an exemplary eight-phase power converter in accordance with some embodiments of the converter of FIG. 3A. The inductors 304A comprise eight inductors (L1 to L8), each having a terminal (Fi) coupled to an associated switch and the other terminal coupled to a common output terminal ($V_{OUT}$). (The capacitor is not shown here.)

Figure 4C:
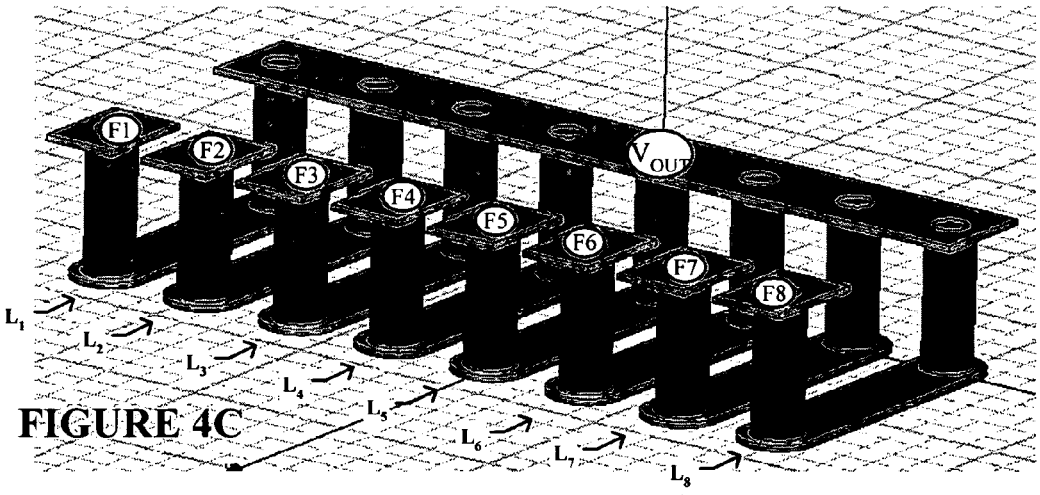
FIG. 4C is a perspective view of multiple inductors with a terminal from each inductor coupled to a common output terminal in accordance with some embodiments.

FIG. 4C shows a perspective view of inductors (L1 to L8) suitable for use as inductors 304A in accordance with some embodiments. They are formed from vias and conductive layer portions, as discussed above, with their inductive areas disposed next to one another as indicated. They comprise inputs (F1 to F8) coupled (through the switches) to the eight differently-phased control signals ($P_0$, $P_{45}$, . . . $P_{315}$) respectively. Thus, the inductors are consecutively driven by the different phase components in the order that they are disposed. They also comprise a common output terminal ($V_{OUT}$) to provide the converter output signal.

The inductors are disposed in an efficient spatial configuration, but since they are in close proximity to each other, the affects of inductive coupling parasitics may be considered. With multiple inductor configurations, the apparent individual input inductances can vary depending on how they are driven and arranged relative to one another due to inductive coupling, which can be constructive (increased inductance and smaller ripple current) or destructive (decreased inductance and larger ripple current). Inductance changes can affect power converter efficiency.

Converter efficiency is generally defined as the percentage of total power consumed by a converter that is supplied to its output load (not shown). It is typically proportional to the overall "quality factor" (Q) of the utilized inductors. An inductor's quality is the ratio of its imaginary (inductive) impedance to its real (resistive) impedance. Accordingly, efficiency can be impaired when apparent inductances decrease due to destructive inductor coupling.

The inductors depicted in FIG. 4C are arranged in a positive inductive alignment with one another. That is, their currents travel in the same angular direction (clockwise or counter-clockwise) when voltages of the same polarity are applied to their input terminal (Fi). With positively aligned inductors, coupling is more destructive when the inductors are driven by signals that are closer to being out of phase by 180 degrees, while coupling is more constructive when the inductors are driven by signals that are closer in phase to one another. Thus, with these positively aligned inductors, to reduce destructive coupling, it is desirable to drive neighboring inductors with phase components that are closer to one another. With the depicted embodiment this is achieved when the inductors are consecutively driven in the order of their alignment. For example, inductor L2, which is driven by $P_{45}$, is next to L1 and L3, which are driven by $P_0$ and $P_{90}$, respectively, the closest phase components to $P_{45}$. Therefore, the inductor configuration of FIG. 4C reduces destructive inductor coupling.

Ripple is another characteristic that can be affected by inductor configuration. Ripple is typically defined as the periodic alternating voltage superimposed on the regulated output voltage. The smaller the ripple the better. Generally speaking, with multi-phase converters, ripple reduction can be enhanced by driving adjacent inductors with phase components that are closer to being 180 degrees out of phase from one another. This occurs due to localized electrical ripple components cancelling each other out. Thus, with the inductors of FIG. 4C, ripple reduction may not be enhanced as desired when neighboring inductors are driven with phase components that are relatively close to one another. (Note that in some applications, this may be acceptable due to other considerations. These embodiments are certainly within the scope of the invention.) In the following sections, embodiments are disclosed that may better address reducing both destructive coupling and ripple for multiple inductors in efficient spatial configurations.

Figure 4D:
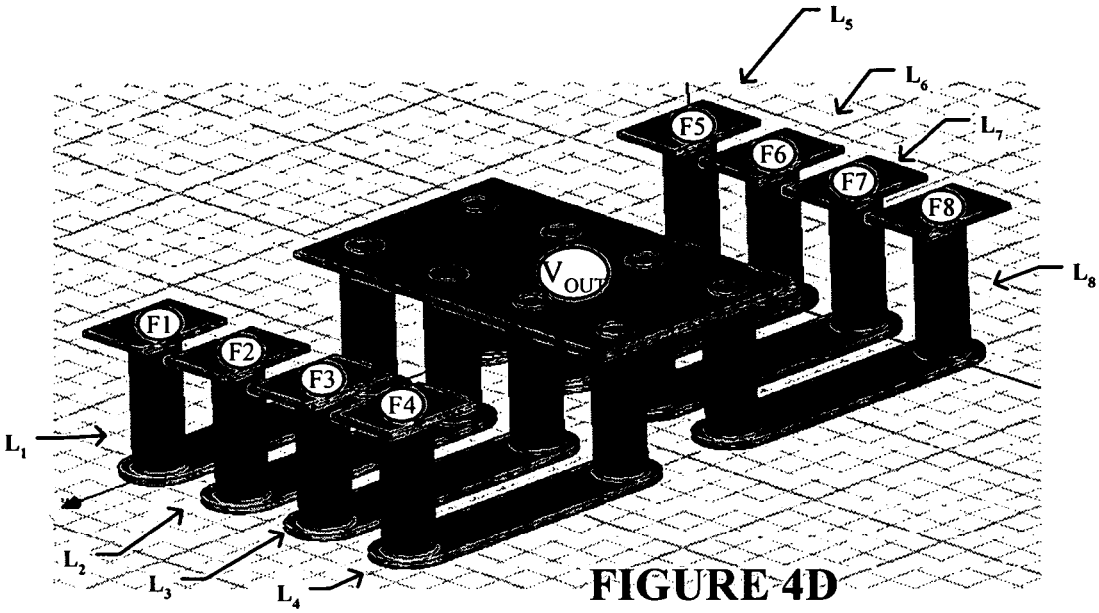
FIG. 4D is a perspective view of multiple inductors with a terminal from each inductor coupled to a conductive layer portion to form a common output terminal in accordance with some other embodiments.

FIG. 4D shows multiple inductors (L1 to L8) in a different configuration in accordance with some embodiments. The inductors are arranged in two adjacent rows (L1/L4 and L5/L8) as indicated. The input terminals (F1 to F8) are on the outside of the configuration, while the common output terminal ($V_{out}$) is coupled to the inductor terminals on the interior of the configuration. Inductors L1 to L4 are in positive inductive alignment with each other, and inductors L5 to L8 are in positive inductive alignment with each other.

Thus, to reduce destructive inductor coupling, phase components for neighboring inductors within L1 to L4 should be close to each other and for neighboring inductors within L5 to L8 should be close to each other. To reduce input and output ripple neighboring inductors from different sets (e.g., L1 and L5) should be closer to 180° out of phase from one another. With the phase components ($P_0$ to $P_{315}$) consecutively driving inductors L1 to L8, these conditions are substantially met, and the inductances will be enhanced relative to other configurations that don't satisfy these conditions. (Note, however, that reducing destructive coupling for inductors in the different sets is not as critical since their inductor regions are farther away from each other; their inductor areas do not even overlap.)

With regard to ripple reduction, this configuration is an improvement of FIG. 4C. Now, neighboring inductors in the different rows are driven by phase components that are closer to being 180° out of phase from one another. For example, the phase difference between L1/L5 is 180°, the phase difference for L1/L6 is 135° (or 225°), the phase difference for L4/L7 is 135°, and so on. The differences for neighboring inductors within the same rows are not as good, but at least phase differences for more neighboring inductor combinations are improved. In the following sections, multiple inductor configurations using complementary pairs are provided, which provides for efficiently housing numerous inductors having reduced destructive coupling and ripple.

Figure 5:
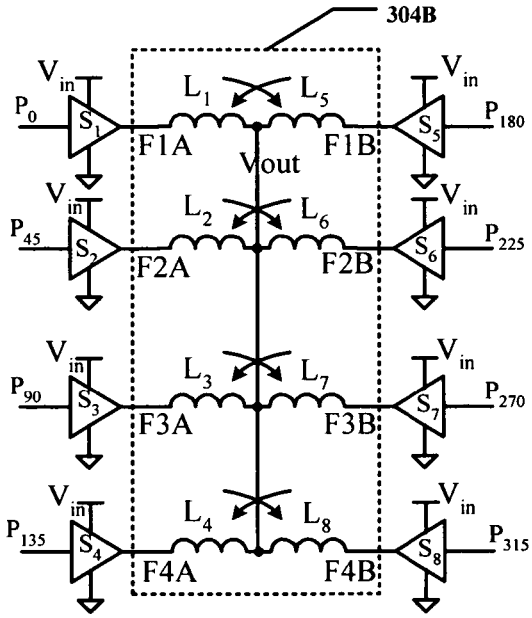
FIG. 5 is a schematic diagram of a portion of the power converter of FIG. 3A in accordance with some embodiments.

FIG. 5 is a schematic diagram of the power converter circuit of FIG. 3B but with multiple inductors 304B configured from complementary inductor pairs.

Figure 6A:
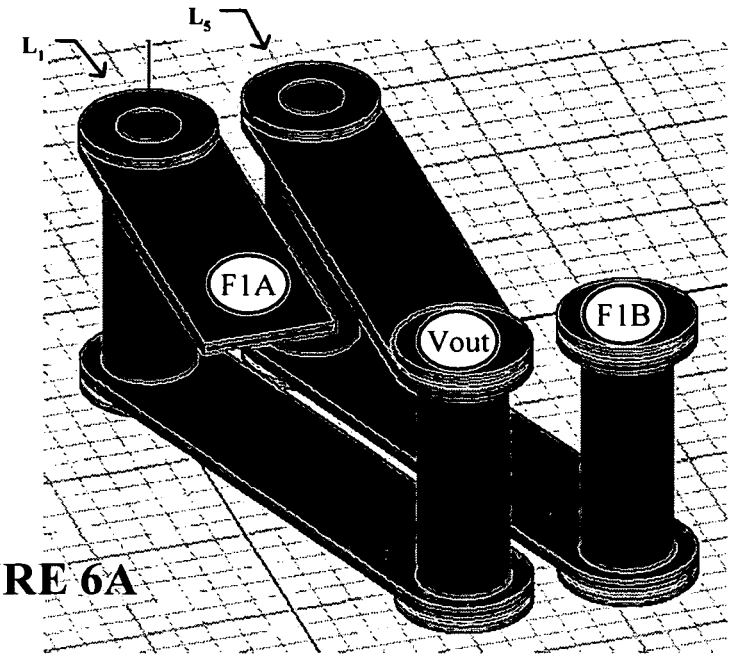
FIG. 6A is a perspective view of a complementary inductor pair in accordance with some embodiments.

FIG. 6A shows a complementary inductor pair, comprising inductors L1 and L5, in accordance with some embodiments. A complementary pair occurs when two inductors are in a complementary (not positive) inductive alignment with each other, a terminal from one inductor is coupled to a terminal from the other inductor, and their magnetic flux regions substantially overlap. (Note that with inductors not using a common magnetic core, such as the depicted inductors, magnetic flux is more widely dispersed, and thus magnetic flux regions can coincide even when the inductors are not tightly spaced, e.g., overlapping turns, together). The use of complementary pairs allows for inductors to be more closely spaced to one another without unreasonable destructive coupling and also provides for ripple reduction. In fact, constructive coupling may be attained to improve converter efficiency. It also may lower the apparent converter output impedance, which typically reduces output decoupling capacitance.

Figure 6B:
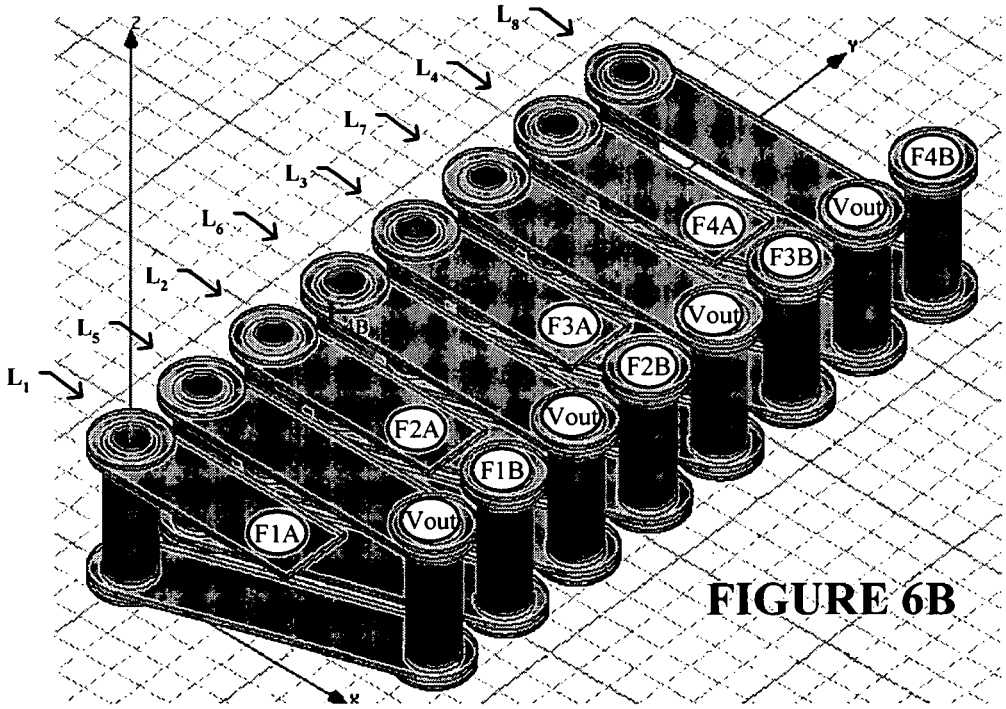
FIG. 6B is a perspective view of a plurality of multiple inductors arranged in complementary pairs, suitable for use with the power converter of FIG. 5, in accordance with some embodiments.

FIG. 6B shows eight inductors (L1 to L8) coupled together using complementary pairs for use as inductors 304B in accordance with some embodiments of the converter of FIG. 5. Each inductor is part of a complementary pair with its adjacent inductor(s). For example, L1/L5 make up a complementary pair, as do L5/L2, L2/L6 and so on. Thus, with the phase components consecutively driving inductors in their numeric order, the inductors that are closest to one another (primary neighbors) are driven by phase components that are close to 180° out of phase from each other. Because they are in complementary inductive alignment, constructive (not destructive) coupling results. At the same time, with these closest inductors receiving out of phase signals, local input and output current ripple reduction is also enhanced. Note that with regard to inductive coupling, these same favorable conditions also apply to secondary inductor neighbors (separated by one inductor).

Figure 7A:
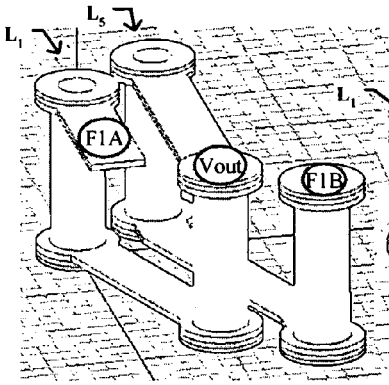
FIG. 7A is a perspective view of the complementary inductor pair of FIG. 6A but with skewed terminals in accordance with some embodiments.
Figure 7B:
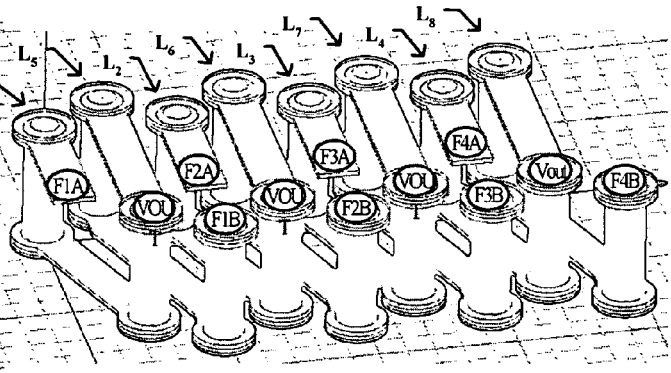
FIG. 7B is a perspective view of a plurality of the complementary inductor pairs of FIG. 7A, suitable for use with the power converter of FIG. 5, in accordance with some embodiments.

FIGS. 7A and 7B show the inductors as in FIGS. 6A and 6B except that their vias are skewed to improve routing density. By skewing, it may be possible to improve the pitch of the inductors on the substrate to the pitch of the terminals on the power converter chip.

Figure 8A:
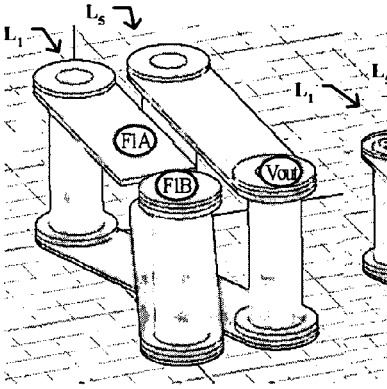
FIG. 8A is a perspective view of a complementary inductor pair in accordance with other embodiments.
Figure 8B:
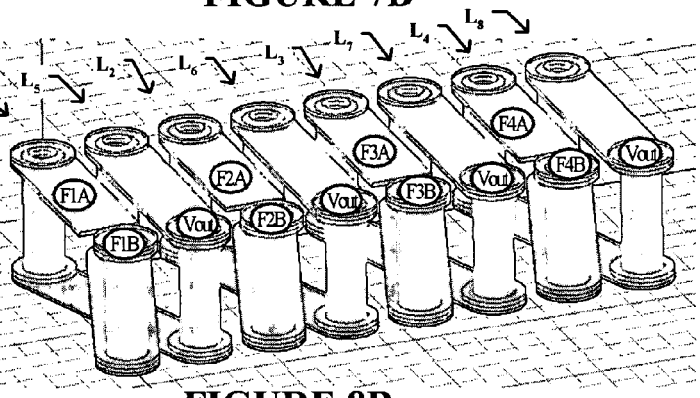
FIG. 8B is a perspective view of a plurality of the complementary inductor pairs of FIG. 8A, suitable for use with the power converter of FIG. 5, in accordance with some embodiments.

FIGS. 8A and 8B show another embodiment of the inductors of FIGS. 6A/6B with crossed conductive layer portions (traces). The crossing can be used to improve constructive coupling between the inductors but it requires an additional conductive layer. However, this embodiment may be preferred, in some applications, over FIGS. 6A/6B because the inductor input terminals can be closer to one another, which among other things, can improve ripple reduction.

Figure 9A:
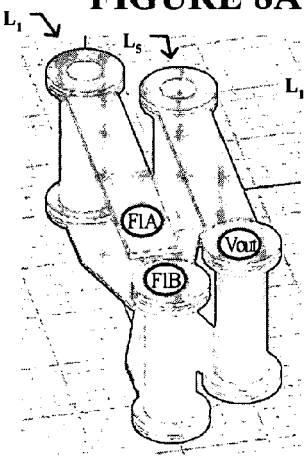
FIG. 9A is a perspective view of the complementary inductor pairs of FIG. 8A with skewed terminals in accordance with some embodiments.
Figure 9B:
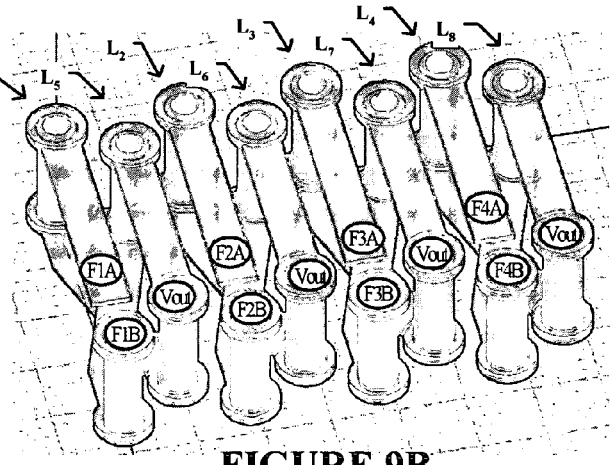
FIG. 9B is a perspective view of a plurality of the complementary inductor pairs of FIG. 9A, suitable for use with the power converter of FIG. 5, in accordance with some embodiments.

FIGS. 9A and 9B show the embodiment of FIGS. 8A/8B except that the vias are skewed to improve routing density.

Figure 10A:
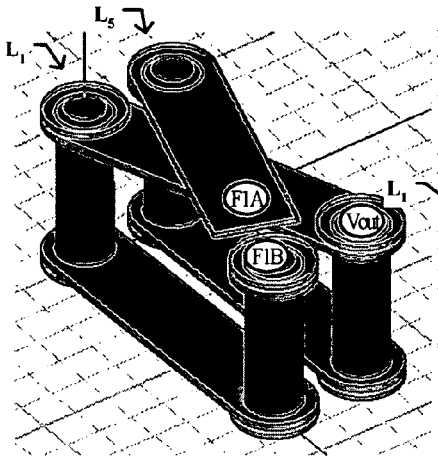
FIG. 10A is a perspective view of a complementary inductor pair in accordance with other embodiments.
Figure 10B:
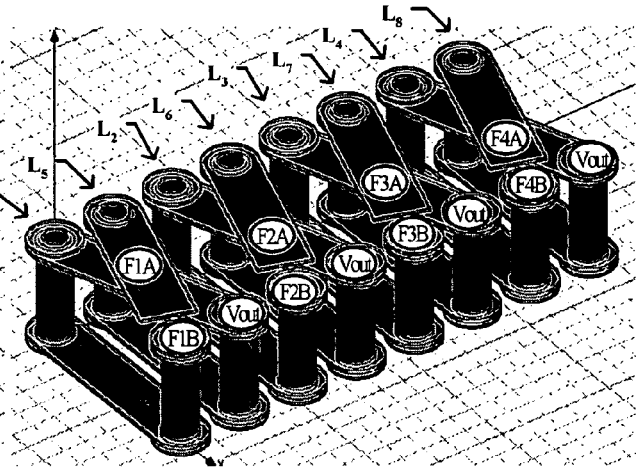
FIG. 10B is a perspective view of a plurality of the complementary inductor pairs of FIG. 10A, suitable for use with the power converter of FIG. 5, in accordance with some embodiments.

FIGS. 10A and 10B show another embodiment with the conductive layer portion "crossovers" realized on the same side of the substrate core as the inductor terminals. This embodiment may be desirable if there is sufficient routing resource available on the terminal side of the substrate.

It should be appreciated that other embodiments not specifically presented are within the scope of the invention. For example, while the disclosed inductors have inductor areas that are substantially vertical relative to a substrate, it is contemplated that they could have a horizontal component (i.e., be angled) depending upon design concerns and/or manufacturing preferences. In addition, while the depicted inductors are implemented with plated through hole vias, any other type of via or member could also be used, depending upon available materials and/or manufacturing processes. They could be formed from layered, deposited, and/or filled holes (e.g., formed from drilling, milling, sacrificial formations), or they could be made from some other structure-forming process.

Moreover, while the use of magnetic materials is not specifically disclosed, they are not discounted from the scope of the invention and may be used in some embodiments. For example, a magnetic material layer could be disposed "beneath" inductors to enhance their inductances. However, the use of such a material may not be desired due to process limitations or other detriments. It is anticipated that the inductors disclosed herein may be used in high frequency (e.g., in excess of 10 MHz.) switching applications, which may make it unfeasible to use a magnetic material.

Furthermore, while an eight phase embodiment has primarily been described for convenience, embodiments disclosed herein may be employed for any number of phases. In fact, the disclosed configurations may be well suited for many phase applications.

Figure 11:
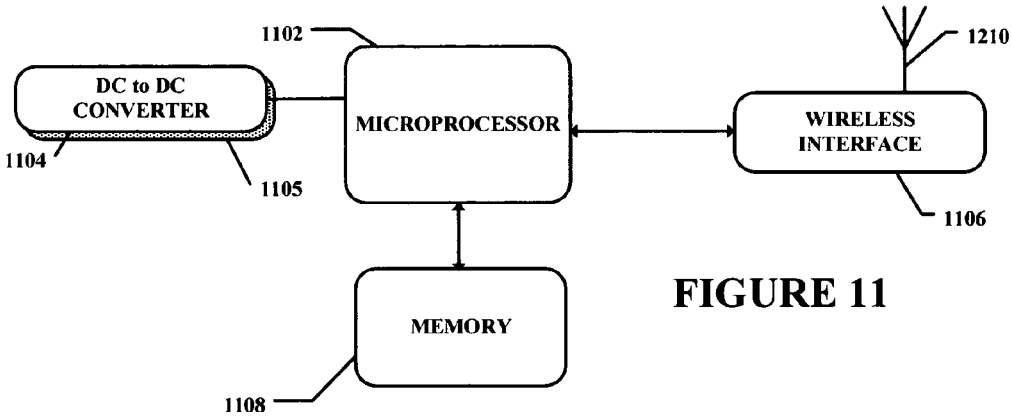
FIG. 11 is a block diagram of a computer system having a power converter with inductors in accordance with some embodiments.

With reference to FIG. 11, one example of a computer system is shown. The depicted system generally comprises a processor 1102 that is coupled to a power converter 1104, a wireless interface 1106, and memory 1108. It is coupled to the converter 1104 to receive from it power when in operation. The wireless interface 1106 is coupled to an antenna 1110 to communicatively link the processor through the wireless interface chip 1106 to a wireless network (not shown). The power converter 1104 comprises a substrate 1105 that includes inductors in accordance with some embodiments disclosed herein.

It should be noted that the depicted system could be implemented in different forms. That is, it could be implemented in a single chip module, a circuit board, or a chassis having multiple circuit boards. Similarly, it could constitute one or more complete computers or alternatively, it could constitute a component useful within a computing system.

The invention is not limited to the embodiments described, but can be practiced with modification and alteration within the spirit and scope of the appended claims. For example, it should be appreciated that the present invention is applicable for use with all types of semiconductor integrated circuit ("IC") chips. Examples of these IC chips include but are not limited to processors, controllers, chip set components, programmable logic arrays (PLA), memory chips, network chips, and the like.

Moreover, it should be appreciated that example sizes/models/values/ranges may have been given, although the present invention is not limited to the same. As manufacturing techniques (e.g., photolithography) mature over time, it is expected that devices of smaller size could be manufactured. In addition, well known power/ground connections to IC chips and other components may or may not be shown within the FIGS. for simplicity of illustration and discussion, and so as not to obscure the invention. Further, arrangements may be shown in block diagram form in order to avoid obscuring the invention, and also in view of the fact that specifics with respect to implementation of such block diagram arrangements are highly dependent upon the platform within which the present invention is to be implemented, i.e., such specifics should be well within purview of one skilled in the art. Where specific details (e.g., circuits) are set forth in order to describe example embodiments of the invention, it should be apparent to one skilled in the art that the invention can be practiced without, or with variation of, these specific details. The description is thus to be regarded as illustrative instead of limiting.

What is claimed is:

1. An apparatus comprising:

a substrate comprising a row of embedded inductors with overlapping inductor areas, wherein adjacent inductors within the row of inductors are complementary inductor pairs with overlapping inductor area and with a terminal of an inductor from the adjacent inductors being coupled to a terminal from another inductor from the adjacent inductors.

2. The apparatus of claim 1, in which the inductors comprise spaced apart vias conductively coupled together with at least a portion of a conductive layer in the substrate.

3. The apparatus of claim 2, in which each inductor comprises a single inductor turn.

4. The apparatus of claim 2, in which the inductors comprise conductive layer portions, used to couple inductor terminals, that cross one another, said conductive layer portions being disposed in separate layers.

5. The apparatus of claim 1, wherein the substrate is part of an integrated circuit and supports an electrical die comprising at least part of a power converter circuit coupled to the inductors.

6. The apparatus of claim 5, wherein the power converter circuit is a multi-phase converter, and wherein phase components, substantially out of phase by 180 degrees from each other, are used for driving the adjacent inductors of the complementary inductor pairs.

7. The apparatus of claim 1, in which the substrate is part of a circuit board and supports an electrical die comprising at least part of a power converter circuit coupled to the inductors.

8. The apparatus of claim 7, in which the power converter circuit is a multi-phase converter, wherein phase components substantially out of phase by 180 degrees drive the adjacent inductors.

9. The apparatus of claim 1, wherein the complementary inductor pairs have respective vias which are skewed relative to one another.

10. The apparatus of claim 5, wherein the power converter circuit is a multiphase buck type switching power converter with complementary inductor pairs.

11. The apparatus of claim 1, wherein another terminal of the inductor from the adjacent inductors being coupled to an output of a switch, and wherein another terminal from the other inductor from the adjacent inductors being coupled to an output of another switch.

12. The apparatus of claim 1, wherein the adjacent inductors of the complementary inductor pairs are driven by phase components that are out of phase by 180 degrees from each other.

13. The apparatus of claim 1, wherein the adjacent inductors are in complementary indicative alignment to cause constructive coupling.

* * * * *